United States Patent [19]

Nonnenmacher

[11] 4,325,677

[45] Apr. 20, 1982

[54] ARRANGEMENT FOR THE REGULATION OF THE OUTPUT AND FOR LIMITING THE OUTPUT FLUID PRESSURE OF AN ADJUSTABLE PUMP

[75] Inventor: Gerhard Nonnenmacher, Korntal, Fed. Rep. of Germany

[73] Assignee: Robert Bosch GmbH, Stuttgart, Fed. Rep. of Germany

[21] Appl. No.: 70,884

[22] Filed: Aug. 29, 1979

[30] Foreign Application Priority Data

Sep. 19, 1978 [DE] Fed. Rep. of Germany ..... 2840687

[51] Int. Cl.[3] ..... F04B 49/00

[52] U.S. Cl. ..... 417/218

[58] Field of Search ..... 60/445, 452; 417/212, 417/218–222

[56] References Cited

U.S. PATENT DOCUMENTS 3,067,693 12/1962 Lambeck ..... 417/219
3,820,920 6/1974 Klimaszewski ..... 417/218 X
4,067,664 1/1978 Robeller ..... 417/218
4,194,364 3/1980 Pahl et al. ..... 60/445

FOREIGN PATENT DOCUMENTS 1450686 3/1969 Fed. Rep. of Germany ..... 60/452

*Primary Examiner*—Carlton R. Croyle
*Assistant Examiner*—Edward Look
*Attorney, Agent, or Firm*—Michael J. Striker

[57] ABSTRACT

An arrangement for regulating the output flow and the output pressure of an adjustable pump includes two parallel throttles arranged, respectively, in an output conduit and in a branch conduit; a spring biased multi-way directional control valve is controlled by differential pressure in the branch conduit upstream of the two throttles to adjust the delivery of the pump; manually closed overpressure control valve connects the branch conduit downstream of the corresponding throttle to a tank and a normally open one-way valve connects the output conduit to the branch conduit downstream of the throttles and interrupts the connection as long as the overpressure control valve is open.

5 Claims, 4 Drawing Figures

ARRANGEMENT FOR THE REGULATION OF THE OUTPUT AND FOR LIMITING THE OUTPUT FLUID PRESSURE OF AN ADJUSTABLE PUMP

BACKGROUND OF THE INVENTION

The present invention relates to an arrangement for regulating the output and for limiting the output fluid pressure of an adjustable pump. Such an arrangement is known in the art in which the pressure difference produced by two in series connected throttles, one of which is located in the output conduit of the pump and the other in a branch circuit connected to the output conduit act on a fluid flow regulating valve. This known arrangement has the disadvantage that, for instance, at the start of a small overpressure in the system or during leakage in a precontrol valve in the branch circuit a fluid stream starts to pass through the throttle which is arranged in the branch circuit. If this occurs the pump is only adjusted in such a manner that the pressure drop at the throttle in the branch circuit will be compensated by a smaller pressure drop at the throttle in the output conduit. From this results a transition region in the pressure through which the output is slowly decreased. Thereby the reduction of the output may extend over an essentially greater pressure region than desired. This in turn will result, during approach of the output pressure to its maximum value, in considerable deviations from the desired value of the output.

SUMMARY OF THE INVENTION

It is an object of the present invention to provide a control arrangement for regulating the output and for limiting the output pressure of an adjustable pump which avoids the disadvantages of such control arrangements known in the art.

It is a further object of the present invention to provide a control arrangement of the aforementioned kind in which during an insignificant flow of fluid over the precontrol valve, for instance during leakage of the latter, the regulating function of the control arrangement will not be influenced.

With these and other objects in view, which will become apparent as the description proceeds, the control arrangement according to the present invention mainly comprises an adjustable pump having an outlet end and a movable adjusting member for adjusting the output of the pump, an outlet conduit connected to the outlet end of the pump, means operatively connected to the adjusting member for moving the latter, throttle means comprising a pair of throttles, circuit means communicating with the outlet conduit and connecting the pair of throttles in parallel to each other, fluid flow regulating valve means for controlling the moving means, in which the fluid flow regulating valve means, in turn, are controlled by a spring and the pressure difference produced by the throttle means, a branch conduit forming part of the circuit means and connected to the output conduit downstream of the throttle means, an overpressure valve in the branch conduit for connecting the latter, when the pressure in the branch conduit surpasses a predetermined pressure, to atmospheric pressure to thereby adjust the pump to a smaller output, and a one-way valve in the branch conduit arranged to interrupt upon opening of the overpressure valve a prior thereto existing connection between the two throttles.

One of the throttles is arranged in the outlet conduit and the other in a conduit forming part of the circuit means and connected at one end to the outlet conduit upstream of the one throttle and on the other end to the branch conduit between the one-way valve and the overpressure valve. The one throttle in the outlet conduit is an adjustable throttle, whereas the other throttle is a throttle having a fixed flow-through cross-section.

The fluid flow regulating valve means is a three port-three position valve movable from a neutral position to two working positions respectively located to opposite sides of the neutral position and the fluid flow regulating valve means is connected to the circuit means so that the pressure upstream of the two throttles acts on one end of the fluid flow regulating valve means tending thereby to move the latter from the neutral to one of the working positions, whereas a spring and the pressure downstream of these throttles acts on the opposite end of the fluid flow regulating valve means tending thereby to move the latter to the other working position. The downstream sides of the two throttles are connected by the aforementioned branch conduit.

The one-way valve is arranged in the branch conduit between the connection of the latter to the outlet conduit and a control conduit leading from the branch conduit to the opposite end of the fluid flow regulating valve means and so as to permit flow of fluid through the circuit means to the outlet conduit while preventing fluid flow in the opposite direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
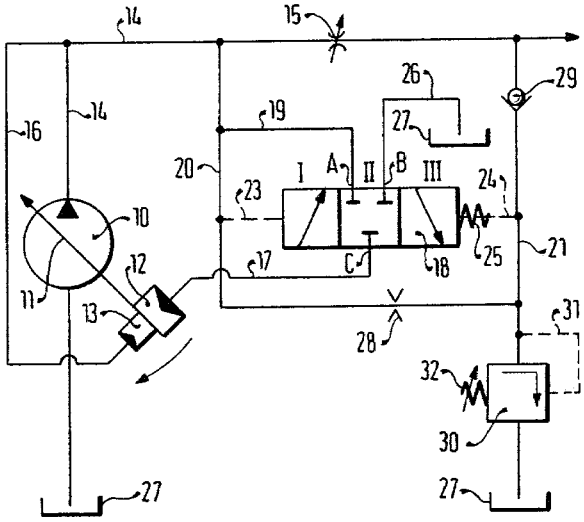
FIG. 1 schematically illustrates one embodiment of the control arrangement according to the present invention.

Referring now to the drawing, and more specifically to FIG. 1, there is schematically illustrated an adjustable pump 10, which, when operated by drive means not shown in the drawing, pumps fluid from a tank 27 into an outlet conduit 14. Output of the pump is controlled by an adjusting member 11, the position of which may be adjusted by two oppositely acting cylinder-and-piston means 12 and 13 operatively connected to the adjusting member 11. Such an adjustable pump as schematically shown in FIG. 1, is well known in the art and, therefore, details of its construction need not to be further described. An adjustable throttle 15 is arranged in the outlet conduit 14. A conduit 16 branches off from the outlet conduit 14 and leads to the cylinder-and-piston means 13, which has a smaller active surface than the cylinder-and-piston means 12. A conduit 17 leads from the cylinder-and-piston means 12 to a fluid flow regulating valve 18 of known construction.

The fluid flow regulating valve 18 is a three port-three position valve, that is it has three ports A, B and C and three positions, that is a neutral position II and two working positions I and III respectively located to opposite sides of the neutral position. The conduit 17 leads from the cylinder-and-piston means 12 to the port C. From the port A leads a conduit 19 to a conduit 20 which is connected at one end to the outlet conduit 14 upstream of the throttle 15 arranged therein. The other end of the conduit 20 communicates with a branch conduit 21, which in turn communicates at one end with the outlet conduit 14 downstream of the throttle 15 therein. A control conduit 23 leads from the conduit 20 to one end of the fluid flow regulating valve means 18, whereas another control conduit 24 leads from the branch conduit 21 to the opposite end of the fluid flow regulating valve means. This opposite side of the fluid flow regulating valve means 18 is also loaded by a control spring 25. A conduit 26 leads from the port B of the fluid flow regulating valve means to a tank 27 under atmospheric pressure. This tank 27 is actually identical with the tank 27 from which the pump 10 pumps fluid into the outlet conduit and the two tanks are shown in FIG. 1 separate from each other for simplication of the schematic drawing. A throttle 28 is located in the conduit 20 downstream of the connection of the control conduit 23 to the conduit 20.

A one-way valve 29 is arranged in the branch conduit 21 between the end of the latter connected to the outlet conduit 14 and the end of the control conduit 24 connected to the branch conduit 21. The one-way valve 29 is constructed to permit flow of fluid through the conduit 21 toward the outlet conduit 14, while preventing such fluid flow in the opposite direction. A precontrol valve 30 in the form of an overpressure valve is located in the branch conduit 21 downstream of the connection of the throttle 28 to the branch conduit 21. The valve 30 is impinged at one end by the fluid pressure in a control conduit 31 connected to the branch conduit 21 whereas the force of a spring 33 acts on the other end of the valve 30. The branch conduit 21 ends downstream of the valve 30 in the tank 27, which again for simplification of the illustration is shown separate from the tank 27 from which the pump 10 sucks fluid and which is actually identical with the latter tank.

The pressure prevailing in the outlet conduit 14 acts continuously through the conduit 16 onto the cylinder-and-piston means 13. A certain pressure difference is created at the throttle 15 by the fluid stream passing through the outlet conduit 14. A part of this stream passes into the conduit 20 and flows over the throttle 28, the branch conduit 21 and the one-way valve 29 back into the outlet conduit 14. If the differential pressure in the branch conduit 20 upstream of the throttles 15 and 28 surpasses, due to increase of the fluid stream pumped by the pump 10, the force of the spring 25, then the fluid flow regulating valve means 18 is shifted from its neutral position II into its working position I. In this position of the fluid flow regulating valve means 18 pressure fluid from the cylinder-and-piston means 12 can flow through the conduits 17 and 26 to the tank 27, whereby the pressure on the piston of the cylinder-and-piston means 12 decreases, so that the force produced by the cylinder-and-piston means 13 will be greater than the decreasing force produced by the cylinder-and-piston means 12 and the adjusting member 11 will thus be turned in counterclockwise direction, reducing thereby the output of the pump 10.

If, however, the differential pressure created by the two throttles is reduced due to a smaller flow output of the pump, then the spring 25 moves the fluid flow regulating valve means 18 to its working position III in which now pressure fluid flows over the conduits 20, 19 and 17 to the cylinder-and-piston means 12, having the larger acting surface, so that the pump will be adjusted to a larger output.

The throttle arrangement for the positioning of the fluid flow regulating valve means 18 consists, therefore, of the adjustable throttle 15 and the throttle 28, connected in parallel to each other.

As long as the fluid pressure in the outlet conduit 14 is below the response pressure at which the valve 30 opens, the control arrangement acts like a usual fluid flow regulating apparatus. If, however, the fluid pressure in the outlet conduit 14 reaches the response pressure of the overpressure valve 30, that is when the latter will be brought to the open position thereof by the fluid pressure in the conduits 20 and 31 acting in opposition to the force of the spring 33, then the fluid stream passing through the conduit 20 and the throttle 28 will flow through the opened overpressure valve 30 to the tank 27. If the fluid pressure in the outlet conduit 14 increases only slightly beyond the response pressure of the valve 30, then the latter opens and the thereby increased pressure drop downstream of the throttle 28 acts as an increased differential pressure on the fluid flow regulating valve means 18 upstream of the throttle 28 and in the manner, as described above, so that the fluid flow regulating valve means 18 is shifted to its working position I. The pump 10 is thereby adjusted to a lower output for such a time until the fluid pressure in the outlet conduit 14 decreases and the overpressure valve 30 is moved by the spring 33 to its closed position. During the open position of the valve 30, the one-way valve 29 will close and thus assures that due to the increased pressure drop downstream of the throttle 28 no pressure fluid will pass from the outlet conduit 14 into the branch conduit 21 and the open valve 30, that is it will produce a separation of the flow regulating function and the pressure regulating function.

Figure 2:
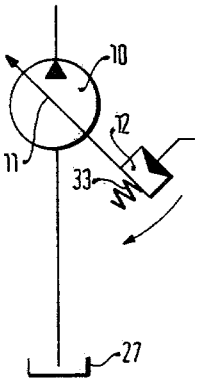
FIG. 2 illustrates a modification of a portion of the control arrangement shown in FIG. 1.

FIG. 2 illustrates a modification of the arrangement shown in FIG. 1, which differs therefrom only in that only the cylinder-and-piston means 12 are supplied with pressure fluid, whereas the opposite force acting on the adjusting member 11 is not produced by a piston-and-cylinder means as shown in FIG. 1, but by a compression spring 32. Such an adjusting arrangement for the adjusting member 11 is likewise known in the art.

Figure 3:
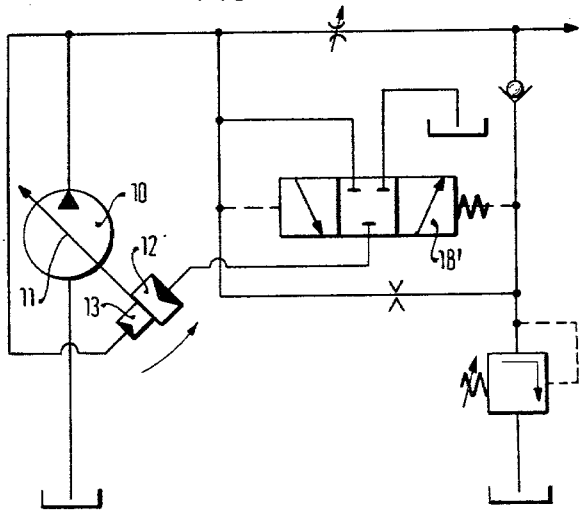
FIG. 3 schematically illustrates a second embodiment of the control arrangement according to the present invention.
Figure 4:
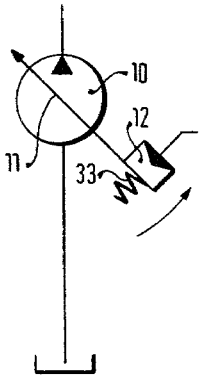
FIG. 4 again illustrates a modification of a detail of the arrangement shown in FIG. 3.

The embodiment as schematically illustrated in FIG. 3 differs from the embodiment shown in FIG. 1 only in that the maximum adjustment of the pump is carried out in the opposite direction as indicated by the arrow adjacent to the cylinder-and-piston means 12 and 13. This requires that the fluid flow regulating valve means, designated in FIG. 3 with the reference numeral 18', will act in the opposite direction as can be ascertained by the fluid stream indicating arrows at the working positions I and III of the valve 18'. The function of the arrangement shown in FIG. 3 is otherwise exactly the same as described in connection with FIG. 1. The same holds true with regard to the embodiment shown in FIG. 4 in which the cylinder-and-piston means 13 is again replaced by a spring 32.

In the actual construction of the control arrangement of the present invention it is possible to form the conduits 20 and 21 in the housing of the fluid flow regulating valves 18 or 18' and the throttle 28 may also be formed in a longitudinal bore of this housing, as usual in pressure and output regulators.

It will be understood that each of the elements described above, or two or more together, may also find a useful application in other types of arrangements for regulating the output and for limiting the output fluid pressure of an adjustable pump differing from the types described above.

While the invention has been illustrated and described as embodied in an arrangement for regulating the output stream and for limiting the fluid pressure of the output stream of an adjustable pump, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control arrangement for regulation of the output flow and output pressure of a working fluid delivered by an adjustable pump having an outlet end and an adjusting member, comprising actuating means coupled to said adjusting member for adjusting the delivery of the pump; an outlet conduit connected to said outlet end; a first throttle in said outlet conduit; a branch conduit connected to said outlet conduit upstream of said first throttle; a second throttle in said branch conduit; a one-way valve connecting said branch conduit downstream of said second throttle to said outlet conduit downstream of said first throttle; a fluid flow regulating valve having ports connected for controlling said actuating means by working fluid upstream of said first throttle, said regulating valve being biased at one end thereof by a biasing spring and attacked at the other end thereof by a differential pressure resulting in said branch conduit upstream of said first and second throttles; a normally closed overpressure control valve connected between said branch conduit downstream of said second throttle and a tank, said overpressure control valve cooperating with said one-way valve to open the same in response to a pressure increase downstream of said second throttle; said regulating valve being a three port-three position valve movable in response to said differential pressure from a neutral position to two working positions located to opposite sides of said neutral position; said actuating means including at least one piston-and-cylinder means operatively connected to said adjusting member of said pump tending to move it in one direction for changing the output of the pump, and means counteracting said one cylinder-and-piston means, said regulating valve in said neutral position preventing flow of fluid into and out from said one cylinder-and-piston means, and connecting in one of said working positions said one cylinder-and-piston means to a tank so that said counteracting means moves said adjusting member in unloading direction, and connecting in the other working position said cylinder-and-piston means to said outlet conduit upstream of said first throttle so as to move said adjusting member against said counteracting means in a loading direction; and wherein one control conduit connects said branch conduit upstream of said second throttle to said other end of said regulating valve, and another control conduit connects said branch conduit downstream of said second throttle to said spring-biased one end of said regulating valve.

2. A control arrangement as defined in claim 1, wherein said first throttle is an adjustable throttle and said second throttle is a throttle having a fixed flow-through cross-section.

3. A control arrangement as defined in claim 1, wherein said counteracting means is another cylinder-and-piston means having an active cross-section smaller than said one cylinder-and-piston means and being connected to said output conduit.

4. A control arrangement as defined in claim 1, wherein said counteracting means is constituted by a spring.

5. A control arrangement as defined in claim 4, wherein said spring is a compression spring abutting with one end against said adjusting member opposite said one cylinder-and-piston means.

* * * * *